US006276025B1

(12) United States Patent
Leibman

(10) Patent No.: US 6,276,025 B1
(45) Date of Patent: Aug. 21, 2001

(54) ADJUSTABLE HINGE

(75) Inventor: Bernard Leibman, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/405,055

(22) Filed: Sep. 27, 1999

(51) Int. Cl.[7] ..... E05D 7/04
(52) U.S. Cl. ..... 16/241; 16/240; 16/242
(58) Field of Search ..... 16/241, 240, 242, 16/238

(56) References Cited

U.S. PATENT DOCUMENTS

| | | | | |
|---|---|---|---|---|
| 4,147,405 | | 4/1979 | Spainhour . | |
| 4,604,769 | | 8/1986 | Roch et al. . | |
| 5,009,159 | | 4/1991 | Stenqvist . | |
| 5,052,077 | * | 10/1991 | Lautenschlager | 16/238 |
| 5,203,115 | | 4/1993 | Marinoni . | |
| 5,339,493 | * | 8/1994 | MacIntyre | 16/238 |
| 5,375,296 | | 12/1994 | Zaleskie . | |
| 5,555,605 | | 9/1996 | Mosher . | |
| 5,669,105 | * | 9/1997 | Depke | 16/245 |
| 5,774,935 | | 7/1998 | Hawley . | |
| 5,826,306 | | 10/1998 | Faubert et al. . | |
| 6,141,830 | * | 11/2000 | Shimooka | 16/237 |

* cited by examiner

*Primary Examiner*—Anthony Knight
*Assistant Examiner*—Mark Williams
(74) *Attorney, Agent, or Firm*—David E. Henn; John M. Kelly

(57) ABSTRACT

A door hinge assembly suitable for attaching a door to a structural member such that the relative position of the door to the structural member can be adjusted. A door hinge assembly includes a mounting plate for attaching the door hinge assembly to a frame, a pin holder for holding a hinge pin, and an arm that connects the pin holder to the mounting plate. The hinge pin includes both a mating body for mating with a receptacle mounted to a door and a flattened body that fits into an elongated opening that passes through the pin holder. The flattened body includes a threaded aperture that aligns with an opening through the pin holder. A captured screw threads through the threaded aperture and across the elongated opening. The captured screw includes an adjustment that is accessible through the pin holder opening.

10 Claims, 5 Drawing Sheets

ADJUSTABLE HINGE

FIELD OF THE INVENTION

The present invention relates to an adjustable hinge suitable for use in a printing machine.

BACKGROUND OF THE INVENTION

Electrophotographic printing is a well-known and commonly used method of copying or printing documents. Electrophotographic printing is performed by exposing a light image representation of a desired document onto a substantially uniformly charged photoreceptor. In response, the photoreceptor discharges so as to create an electrostatic latent image of the desired document on the photoreceptor's surface. Toner particles are then deposited onto that latent image so as to form a toner image. That toner image is then transferred from the photoreceptor onto a substrate such as a sheet of paper. The transferred toner image is then fused to the substrate, usually using heat and/or pressure. The surface of the photoreceptor is then cleaned of residual developing material and recharged in preparation for the production of another image.

Electrophotographic printers are comprised of a large number of individual components, including numerous structural components and mechanical devices. For example, larger electrophotographic printers usually have door panels that are supported by hinges. Due to mechanical tolerances such door panels do not always attach to the printer frame with the desired fit. For example, the top of a front door panel might need to be moved back to properly align with another door panel or a machine frame. In such cases it is common to forcibly bend the door hinge or frame mount to properly align the door panel. However, forced bending may have to be repeated until the proper fit is achieved. Even then, such bending can introduce other fit problems with the door, such as introducing a misfit at the bottom of the door. While other adjustment options exist, such as using a door hinge assembly with slotted screw mounting holes that enable relative movement, in general an easier door adjustment technique would be beneficial.

SUMMARY OF THE INVENTION

The principles of the present invention provide for a new type of door hinge assembly. A door hinge assembly according to the present invention is useful for joining a door to a structural member such that the relative position of the door to the structural member can be adjusted.

A door hinge assembly according to the principles of the present invention includes a mounting plate for attaching the door hinge assembly to a frame, a pin holder for holding a hinge pin, and an arm that connects the pin holder to the mounting plate. The hinge pin includes both a cylindrical portion for mating with a receptacle mounted on a door and a flattened body that fits into an elongated opening that passes through the pin holder. The flattened body includes a threaded aperture that aligns with an opening through the pin holder. A captured screw threads through the threaded aperture and across the elongated opening. The captured screw includes an adjustment that is accessible through the pin holder opening. By turning the captured screw, the position of the pin in the inner cavity is changed. Thus, a relative position of a door to a frame can be changed by turning the captured screw.

BRIEF DESCRIPTION OF THE DRAWINGS

The invention will be described in detail herein with reference to the following figures in which like reference numerals denote like elements and wherein.

DETAILED DESCRIPTION OF PREFERRED EMBODIMENTS OF THE INVENTION

While the principles of the present invention will be described in connection with a preferred embodiment adjustable hinge assembly, it should be understood that the present invention is not limited to that embodiment. On the contrary, the present invention is intended to cover all alternatives, modifications, and equivalents as may be included within the spirit and scope of the invention as defined by the appended claims.

Figure 1:
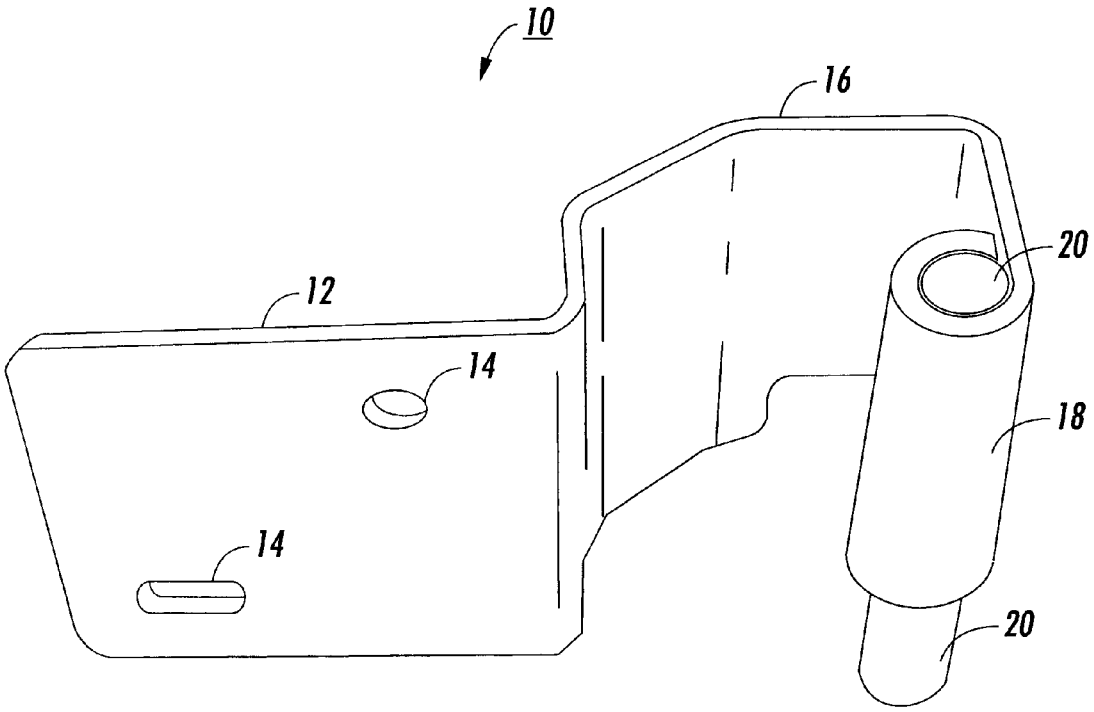
FIG. 1 (Prior Art)
FIG. 1 is a perspective view of a prior art door hinge assembly.

FIG. 1 presents a perspective view of a prior art door hinge assembly 10. That assembly includes a mounting plate 12 having openings 14 for receiving fasteners that attach the door hinge assembly to a frame of some type, such as the frame of an electrophotographic printing machine. The door hinge assembly 10 also includes an arm section 16 that extends from the mounting plate 12 to a barrel 18. That barrel is tightly wrapped around a cylindrical pin 20. As is well known, the pin inserts into a receptacle that is mounted to a door of some type, such as a door panel on an electrophotographic printing machine. Thus, the door hinge assembly 10 is useful for attaching a door to a frame such that the door can pivot on the pin.

Figure 2:
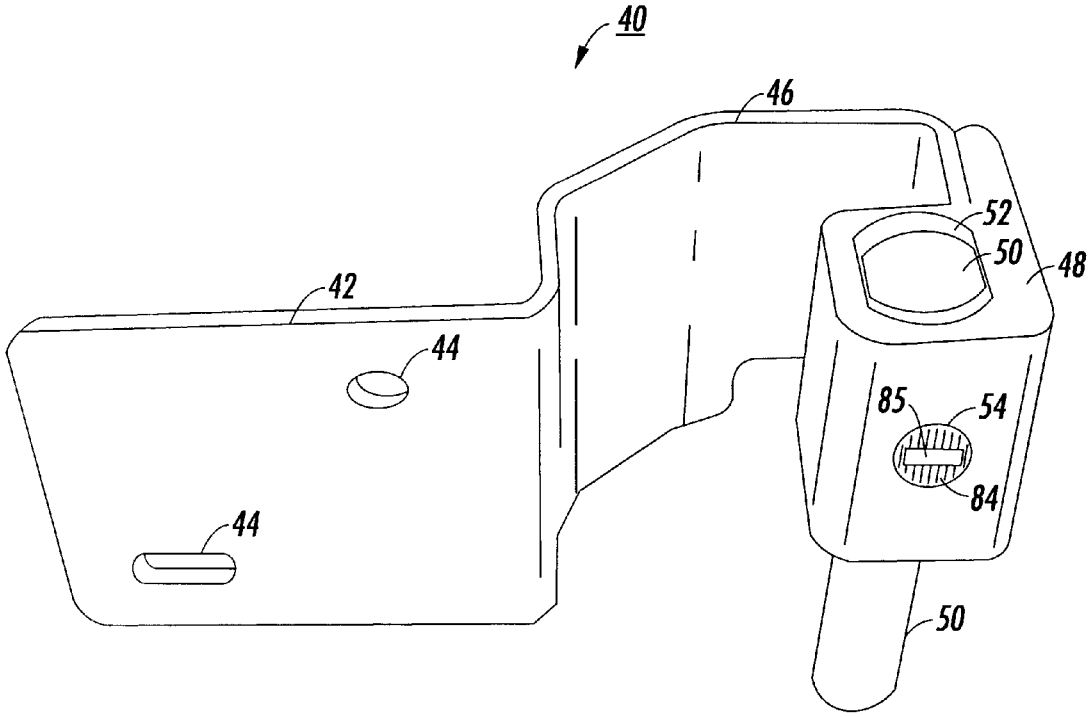
FIG. 2 is a perspective view of an adjustable hinge assembly according to the principles of the present invention.

In contrast to the prior art door hinge assembly 10, FIG. 2 illustrates an adjustable door hinge assembly 40 that is in accord with the principles of the present invention. A door hinge assembly 40 includes a mounting plate 42 having openings 44 for receiving fasteners that attach the door hinge assembly to a frame of some type, such as the frame of an electrophotographic printing machine. The door hinge assembly 40 also includes an arm 46 that connects the mounting plate to a pin holder 48 having an elongated opening 52 formed by a wall of the pin holder. The pin holder receives a hinge pin 50 in the elongated opening 52. The pin holder also includes an adjustment opening 54.

Figure 3:
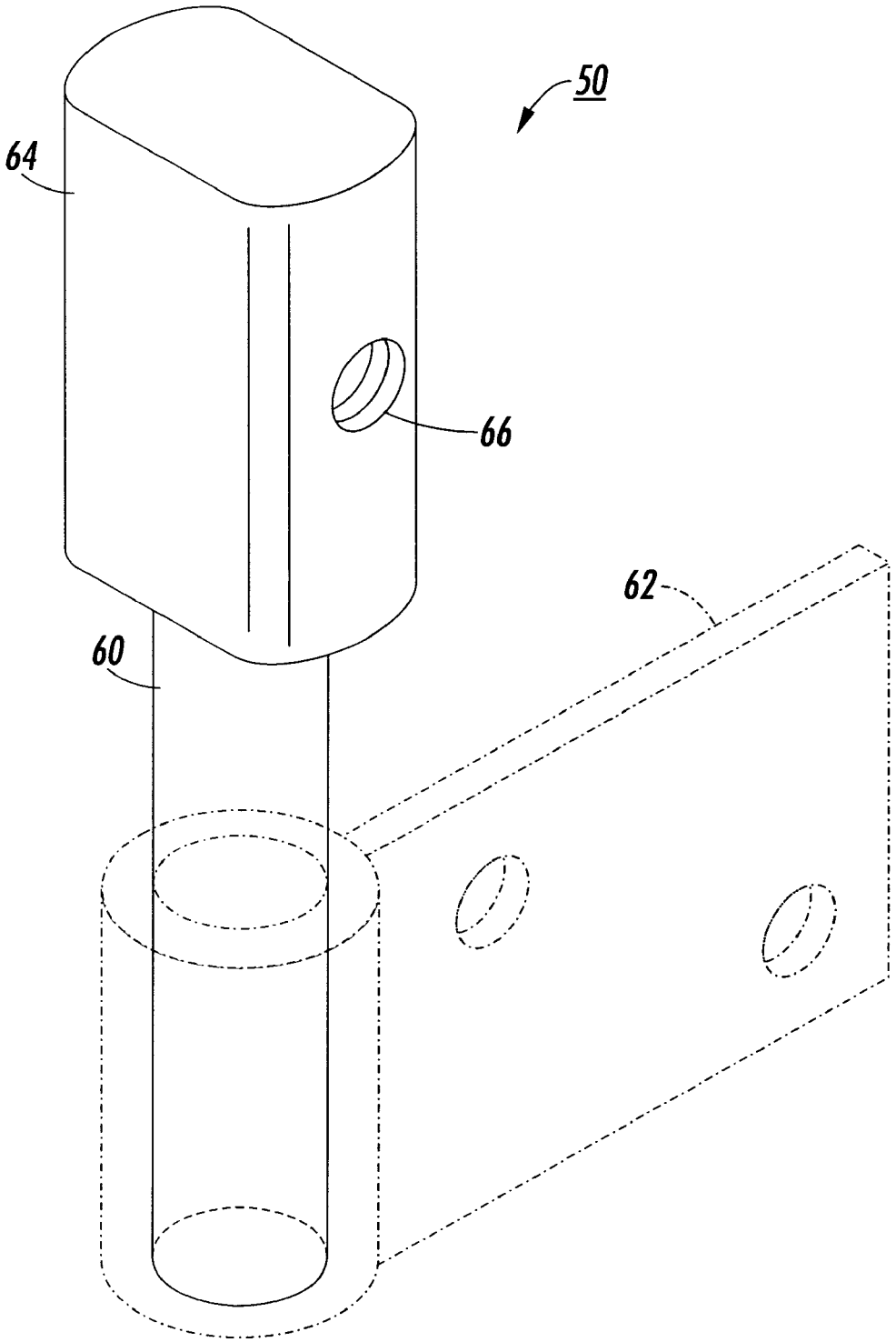
FIG. 3 is a perspective view of the pin of the adjustable hinge assembly according to FIG. 2.

Turning now to FIG. 3, unlike the simple cylindrical pin 20 used in the door hinge assembly 10, the hinge pin 50 includes not only a cylindrical portion 60 for inserting into a receptacle 62, but also a flattened portion 64. The hinge pin further includes a threaded aperture 66 that passes through the flattened portion.

Figure 4:
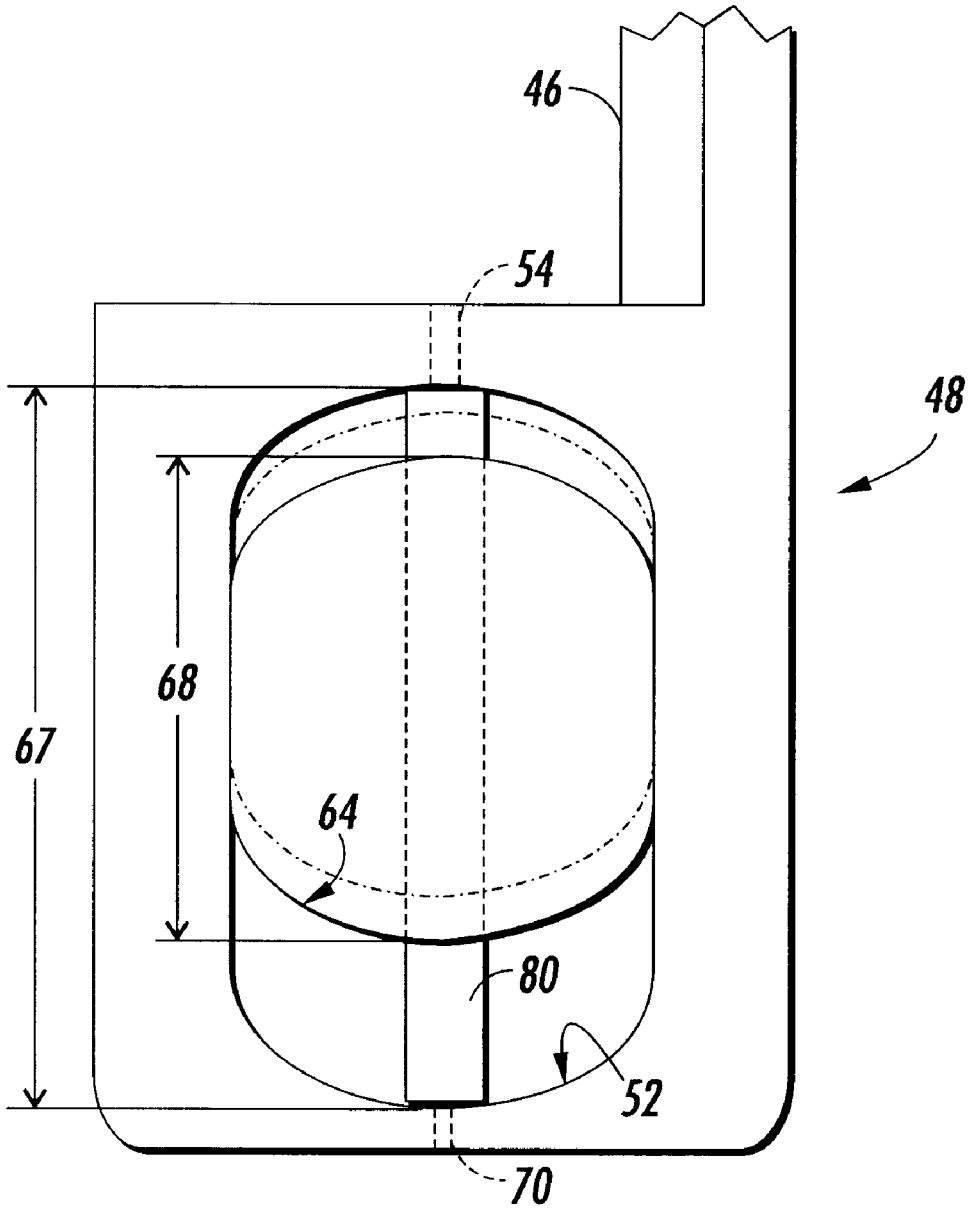
FIG. 4 is a partial top view of the pin holder of the adjustable hinge assembly according to FIG. 2.

Turn now to FIG. 4 for a better view of the elongated opening 52 through the pin holder 48. The elongated opening 52 is dimensioned such that the flattened portion 64 fits snuggly in one direction and such that a length 67 of the elongated portion is greater than a length 68 of the flattened portion. This enables the hinge pin to move in the direction of elongation of the opening. Still referring to FIG. 4, the pin holder 48 includes a small opening 70 across from the adjustment opening 54.

Figure 5:
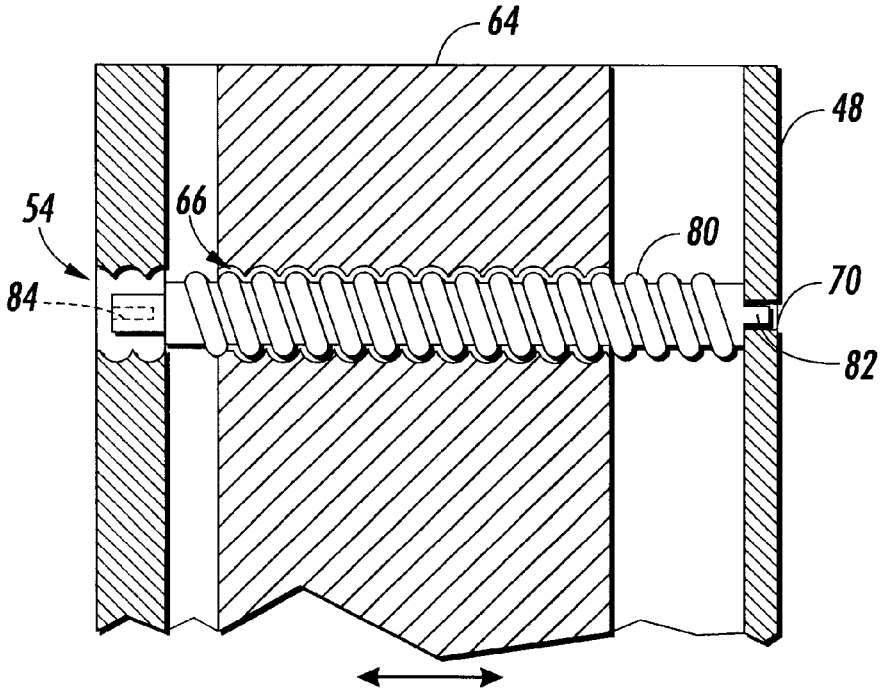
FIG. 5 is a sectional view of a captured screw threaded into the pin and passing through the pin holder of the adjustable hinge assembly of FIG. 2.

Referring now to both FIGS. 4 and 5, the hinge pin 50 is inserted into the elongated opening 52 while a captured screw 80 threads through the threaded aperture 66. The captured screw includes a pivot member 82 that extends into the small opening 70 and a small adjustment member 84 that mounts inside the opening 54. The adjustment member 84 includes a slit for receiving a screwdriver such that the screwdriver can turn the captured screw.

By turning the captured screw 80 the position of the pin in the elongated opening 52 is changed. When the door hinge assembly is used to mount a door on a frame, turning the captured screw moves the door relative to the frame in the direction of elongation of the elongated opening 52.

It should be noted that a door hinge assembly according to the principles of the present invention can be made from a very wide range of materials, include metals such as aluminum or steel, and plastic, such as a nylon or PVC. Therefore, while this invention has been described in conjunction with a preferred embodiment, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A door hinge assembly, comprising a mounting plate;

a pin holder having a wall that forms an elongated opening for holding a hinge pin, said pin holder further including an adjustment opening through said wall;

an arm that connects the pin holder to the mounting plate;

a hinge pin having a mating portion for mating with an external receptacle and a flattened portion that fits into said elongated opening, said flattened body including a threaded aperture that aligns with said adjustment opening; and a captured screw threaded through said threaded aperture, said captured screw having an adjustment accessible through said adjustment opening wherein rotation of said captured screw moves the position of said hinge pin within said pin holder.

2. A door hinge according to claim 1, wherein rotation of said captured screw moves the position of said hinge pin within said pin holder.

3. A door hinge according to claim 1, wherein said mounting plate includes an aperture for receiving a fastener that mounts said mounting plate to a frame.

4. A door hinge according to claim 3, wherein said mating portion is cylindrical.

5. A door hinge according to claim 1 wherein the elongated opening possesses a shape that allows translation of the hinge pin within the pin holder and perpendicular to a longitudinal axis of the hinge pin, the pin holder further having the adjustment opening aligned with the threaded aperture of the flattened portion of the hinge pin.

6. A method of using the door hinge of claim 1 comprising:

affixing the mounting plate to a door frame;

inserting the mating portion into a receptacle; and rotating the adjusting screw so as to move the hinge pin to a position in which the door is aligned with the door frame.

7. A door hinge assembly, comprising:

a hinge pin including a flattened portion and a mating portion that mates with an external receptacle, the flattened portion including a threaded aperture;

a pin holder having a wall that forms an elongated opening that holds the flattened portion of the hinge pin against rotation relative to the pin holder, the elongated opening possessing a shape that allows translation of the hinge pin within the pin holder and perpendicular to a longitudinal axis of the hinge pin, the pin holder further including an adjustment opening through said wall and aligned with the threaded aperture of the flattened portion of the hinge pin;

a captured screw threaded through said threaded aperture, the captured screw having an adjustment accessible through the adjustment opening wherein rotation of the captured screw changes the translational position of the hinge pin within the pin holder;

a mounting plate; and an arm connecting the pin holder to the mounting plate.

8. A door hinge according to claim 7, wherein the mounting plate includes an aperture for receiving a fastener that mounts the mounting plate to a frame.

9. A xerographic printing machine comprising:

a machine body housing at least:

a data controller receiving data corresponding to an image of a page to be printed;

a raster output scanner receiving the data from the data controller;

a photoreceptor belt onto which the raster output scanner places an image in the form of an electric charge by exposing the photoreceptor belt to light of a predetermined wavelength in a pattern in accordance with the image sent to the raster output scanner;

a developer station at which toner is transferred to the electric charge pattern portion of the photoreceptor belt;

an image transfer station at which the toner is transferred to a substrate;

a fusing station at which the toner is fused to the substrate; and a cleaning station at which the photoreceptor is discharged and residual toner is removed;

an access opening in the machine body;

a door frame in the access opening;

a mounting plate of a hinge assembly affixed to one of the door frame and a door;

a pin holder with a wall forming an elongated opening adapted for holding a hinge pin and including an adjustment opening through the wall;

an arm connecting the pin holder to the mounting plate;

a hinge pin with a flattened portion that fits in the pin holder and a mating portion that fits into an external receptacle in the other of the door and the door frame, the flattened portion including a threaded aperture that aligns with the adjustment opening in the pin holder wall; and a captured screw threaded through the hinge pin threaded aperture, the captured screw having an adjustment accessible through the pin holder wall adjustment opening so that rotation of the captured screw via the adjustment moves the hinge pin within the pin holder, thereby adjusting an alignment of the door relative to the door frame.

10. The xerographic machine of claim 9 wherein the elongated opening possesses a shape that allows translation of the hinge pin within the pin holder and perpendicular to a longitudinal axis of the hinge pin, the pin holder further having the adjustment opening aligned with the threaded aperture of the flattened portion of the hinge pin.

* * * * *